US010262585B2

(12) United States Patent
Senda et al.

(10) Patent No.: US 10,262,585 B2
(45) Date of Patent: Apr. 16, 2019

(54) ORGANIC LIGHT-EMITTING DISPLAY APPARATUS AND DRIVING METHOD THEREFOR

(71) Applicant: SAMSUNG DISPLAY CO., LTD., Yongin-si, Gyeonggi-do (KR)

(72) Inventors: Takahiro Senda, Yongin-si (KR); Kyunghoon Chung, Yongin-si (KR)

(73) Assignee: Samsung Display Co., Ltd. (KR)

( * ) Notice: Subject to any disclaimer, the term of this patent is extended or adjusted under 35 U.S.C. 154(b) by 101 days.

(21) Appl. No.: 14/936,553

(22) Filed: Nov. 9, 2015

(65) Prior Publication Data

US 2016/0267844 A1 Sep. 15, 2016

(30) Foreign Application Priority Data

Mar. 13, 2015 (KR) ..... 10-2015-0035153

(51) Int. Cl.

| | |
|---|---|
| ***G09G 3/32*** | (2016.01) |
| ***G09G 3/3233*** | (2016.01) |
| ***G09G 3/20*** | (2006.01) |
| ***G09G 3/3291*** | (2016.01) |

(52) U.S. Cl.

CPC ..... *G09G 3/3233* (2013.01); *G09G 3/2018* (2013.01); *G09G 3/3291* (2013.01); *G09G 2300/043* (2013.01); *G09G 2300/0852* (2013.01); *G09G 2300/0861* (2013.01); *G09G 2300/0866* (2013.01); *G09G 2320/0295* (2013.01); *G09G 2320/045* (2013.01)

(58) Field of Classification Search

CPC .... G09G 3/3233; G09G 3/3283; G09G 3/325; G09G 3/3291; G09G 3/2018

USPC ..... 315/297; 345/76, 7, 212, 214, 690

See application file for complete search history.

(56) References Cited

U.S. PATENT DOCUMENTS

2009/0051628 A1* 2/2009 Kwon ..... G09G 3/3233 345/77
2011/0084955 A1* 4/2011 Kim ..... G09G 3/3283 345/212

(Continued)

FOREIGN PATENT DOCUMENTS

KR 10-2009-0020190 A 2/2009
KR 10-2011-0124656 A 11/2011

(Continued)

*Primary Examiner* — Abdul-Samad A Adediran
(74) *Attorney, Agent, or Firm* — Innovation Counsel LLP

(57) ABSTRACT

An organic light-emitting display apparatus includes an organic light-emitting diode, a driving transistor arranged to receive a first driving voltage and to supply a driving current to the organic light-emitting diode, a data line arranged to transfer a sustain voltage and a data voltage, a sensing transistor which is connected to the data line, and which is arranged to transfer the sustain voltage to an anode of the organic light-emitting diode in response to a sensing control signal, a switching transistor which is connected to the data line, and which is arranged to transfer the data voltage to the driving transistor in response to a scan signal, and a data compensation unit arranged to compensate image data according to characteristic information of the organic light-emitting diode, the characteristic information transmitted to the data compensation unit through the sensing transistor and the data line.

16 Claims, 7 Drawing Sheets

(56) References Cited

U.S. PATENT DOCUMENTS

| | | | | |
|---|---|---|---|---|
| 2011/0210958 | A1* | 9/2011 | Yoo | G09G 3/325 345/214 |
| 2011/0227505 | A1* | 9/2011 | Park | H05B 33/0896 315/297 |
| 2011/0279437 | A1* | 11/2011 | Komiya | G09G 3/3233 345/212 |
| 2011/0279484 | A1* | 11/2011 | Han | G09G 3/3233 345/690 |
| 2012/0146979 | A1 | 6/2012 | Kim et al. | |
| 2014/0071027 | A1* | 3/2014 | Jin | G09G 3/3291 345/76 |
| 2014/0139565 | A1* | 5/2014 | Choi | G09G 3/2018 345/691 |
| 2014/0306946 | A1 | 10/2014 | Senda | |

FOREIGN PATENT DOCUMENTS

| | | | |
|---|---|---|---|
| KR | 10-1082234 | B1 | 11/2011 |
| KR | 10-2012-0065716 | A | 6/2012 |
| KR | 10-2014-0123219 | A | 10/2014 |

* cited by examiner

ORGANIC LIGHT-EMITTING DISPLAY APPARATUS AND DRIVING METHOD THEREFOR

CROSS-REFERENCE TO RELATED APPLICATION

This application claims the benefit of Korean Patent Application No. 10-2015-0035153, filed on Mar. 13, 2015 in the Korean Intellectual Property Office, the disclosure of which is incorporated herein in its entirety by reference.

BACKGROUND

1. Field

One or more exemplary embodiments relate generally to flat panel displays. More specifically, one or more exemplary embodiments relate to an organic light-emitting display apparatus and a method of driving the same.

2. Description of the Related Art

Organic light-emitting display apparatuses use an organic light-emitting diode, the luminance of which is controlled by a current or a voltage. The organic light-emitting diode includes a positive electrode layer and a negative electrode layer forming an electric field, and an organic emission material which emits light due to the electric field.

A pixel in an organic light-emitting display apparatus includes the organic light-emitting diode, a driving transistor which controls an amount of current supplied to the organic light-emitting diode, and a switching transistor which transfers a data voltage for controlling an emission amount of the organic light-emitting diode to the driving transistor.

The organic light-emitting display apparatus may be driven by a driving method in which a deviation from a threshold voltage of the driving transistor is compensated for and then a data signal is input to the pixels. After the compensation of the threshold voltage, an anode voltage of the organic light-emitting diode may gradually increase due to effects of a noise current, etc. When the anode voltage increases, a gate voltage of the driving transistor also gradually increases due to a capacitive coupling between a gate electrode and a drain electrode of the driving transistor. Since pixels receive the data signal at different points in time according to locations of the pixels, the rise in the gate voltage produces differing effects on the pixels according to the locations of the pixels. As a result, an image is non-uniformly displayed.

In order for the organic light-emitting diode to emit light, the driving transistor needs to continually maintain an on state, and as time passes, a threshold voltage (Vth) of the driving transistor may increase and a current flow may decrease. Also, as emission time of the organic light-emitting diode increases, an emission efficiency of the organic light-emitting diode may decrease. If these phenomena continue, a deterioration of image qualities may occur. Therefore, characteristics of the driving transistor and the organic light-emitting diode need to be accurately sensed and differences in these characteristics should be accurately compensated for.

SUMMARY

One or more exemplary embodiments include an organic light-emitting display apparatus having improved image quality, and a method of driving the same.

Additional aspects will be set forth in part in the description which follows and, in part, will be apparent from the description, or may be learned by practice of the presented embodiments.

According to one or more exemplary embodiments, an organic light-emitting display apparatus includes: an organic light-emitting diode; a driving transistor arranged to receive a first driving voltage and to supply a driving current to the organic light-emitting diode; a data line arranged to transfer a sustain voltage and a data voltage; a sensing transistor which is connected to the data line, and which is arranged to transfer the sustain voltage to an anode of the organic light-emitting diode in response to a sensing control signal; a switching transistor which is connected to the data line, and which is arranged to transfer the data voltage to the driving transistor in response to a scan signal; and a data compensation unit arranged to compensate image data according to characteristic information of the organic light-emitting diode, the characteristic information transmitted to the data compensation unit through the sensing transistor and the data line.

The organic light-emitting display apparatus may further include a compensation transistor arranged to diode-connect the driving transistor in response to a compensation control signal.

The apparatus may be programmed to, during one frame, turn on the sensing transistor so as to initialize an anode voltage of the organic light-emitting diode after the compensation transistor is turned on, and turn on the switching transistor so as to transfer the data voltage after the sensing transistor is turned on.

The frame may include, in order, a threshold voltage compensation section in which the compensation transistor is turned on, an anode initialization section in which the sensing transistor is turned on, and a data write section in which the switching transistor is turned on.

The frame may further include a reset section in which the driving transistor is turned on while a high level of a second driving voltage is applied to a cathode of the organic light-emitting diode before the threshold voltage compensation section, and an emission section in which the organic light-emitting diode emits light according to the data voltage upon receiving a low level of the second driving voltage after the data write section.

The organic light-emitting display apparatus may further include a first capacitor which has a first electrode connected to the switching transistor and a second electrode connected to the gate electrode of the driving transistor, so as to store a threshold voltage of the driving transistor; and a second capacitor which has a first electrode connected to the first electrode of the first capacitor and a second electrode arranged to receive the first driving voltage, so as to store the data voltage.

The organic light-emitting display apparatus may further include a sensing unit arranged to supply a reference current to the organic light-emitting diode, to sense a voltage of the anode of the organic light-emitting diode when the reference current flows in the organic light-emitting diode, and to provide the sensed voltage to the data compensation unit as the characteristic information. The sensing transistor may be further arranged to receive the reference current output from the sensing unit via the data line and transfer the reference current to the organic light-emitting diode, and to transfer the voltage of the anode of the organic light-emitting diode to the sensing unit via the data line.

The sensing unit may sense the driving current output from the driving transistor, and provide the sensed current to the data compensation unit as characteristic information of the driving transistor. The data compensation unit may compensate the image data according to the characteristic information of the driving transistor. The sensing transistor may transfer the driving current output from the driving transistor to the sensing unit via the data line.

The organic light-emitting display apparatus may further include a driving voltage supply unit arranged to supply two levels of the first driving voltage, the two levels of the first driving voltage including a high level and a low level, and to supply two levels of a second driving voltage to a cathode of the organic light-emitting diode, the two levels of the second driving voltage including a high level and a low level.

The sustain voltage may have substantially the same magnitude as the high level of the first driving voltage.

According to one or more exemplary embodiments, an organic light-emitting display apparatus includes: an organic light-emitting diode; a driving transistor arranged to receive a first driving voltage and to supply a driving current to the organic light-emitting diode; a sensing transistor which is connected to a sensing line so as to transfer an initialization voltage from the sensing line to an anode of the organic light-emitting diode in response to a sensing control signal; a switching transistor which is connected to a data line so as to transfer a data voltage from the data line to the driving transistor in response to a scan signal; and a data compensation unit arranged to compensate image data according to characteristic information of the organic light-emitting diode, the characteristic information transmitted to the data compensation unit through the sensing transistor and the sensing line.

The organic light-emitting display apparatus may further include a compensation transistor arranged to diode-connect the driving transistor in response to a compensation control signal. During one frame, the apparatus may be further programmed to turn on the sensing transistor so as to initialize the anode of the organic light-emitting diode after the compensation transistor is turned on, and turn on the switching transistor so as to transfer the data voltage after the sensing transistor is turned on.

The organic light-emitting display apparatus may further include a first capacitor which has a first electrode connected to the switching transistor and a second electrode connected to the gate electrode of the driving transistor, so as to store a threshold voltage of the driving transistor; and a second capacitor which has a first electrode connected to the first electrode of the first capacitor and a second electrode arranged to receive the first driving voltage, so as to store the data voltage.

The organic light-emitting display apparatus may further include a sensing unit arranged to supply a reference current to the organic light-emitting diode, senses a voltage of the anode of the organic light-emitting diode when the reference current flows in the organic light-emitting diode, and to provide the sensed voltage to the data compensation unit as the characteristic information. The sensing transistor may be further arranged to receive the reference current output from the sensing unit via the sensing line, to transfer the reference current to the organic light-emitting diode, and to transfer the voltage of the anode of the organic light-emitting diode to the sensing unit via the sensing line.

According to one or more exemplary embodiments, a method of driving an organic light-emitting display apparatus is presented, where the apparatus includes a pixel including: an organic light-emitting diode; a driving transistor which has a source arranged to receive a first driving voltage and a drain which is connected to the organic light-emitting diode; a switching transistor which is connected to a data line so as to be arranged to transfer a data voltage to a first node in response to a scan signal; a first capacitor which is connected between the first node and a gate of the driving transistor; a second capacitor which is connected between the first node and the source of the driving transistor; a compensation transistor which connects the gate and the drain of the driving transistor in response to a compensation control signal; and a sensing transistor which is connected to the data line so as to be arranged to transfer a first sustain voltage to an anode of the organic light-emitting diode in response to a sensing control signal. The method includes performing an anode initialization operation in which, during one frame, the switching transistor is turned off, the compensation transistor is turned off, the sensing transistor is turned on, and the first sustain voltage is applied to the anode of the organic light-emitting diode.

The method may further include performing a reset operation in which the organic light-emitting diode becomes non-emissive by transitioning a second driving voltage applied to a cathode of the organic light-emitting diode from a low level to a high level, and removing a hysteresis of the driving transistor by supplying a second sustain voltage to the data line.

The method may further include, after the reset operation, performing an anode reset operation in which an anode voltage of the organic light-emitting diode is reset by transitioning the first driving voltage to a low level in a state in which the driving transistor is turned on.

The method may further include, between the anode reset operation and the anode initialization operation, performing a threshold voltage compensation operation in which a threshold voltage of the driving transistor is stored in the first capacitor by turning on the compensation transistor.

The method may further include, after the anode initialization operation, performing a data write operation in which the data voltage is stored in the second capacitor by turning off the compensation transistor, turning off the sensing transistor, and turning on the switching transistor.

The method may further include, after the data write operation, performing an emission operation in which the organic light-emitting diode emits light according to the data voltage, the emission operation comprising transitioning the second driving voltage from the high level to the low level.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
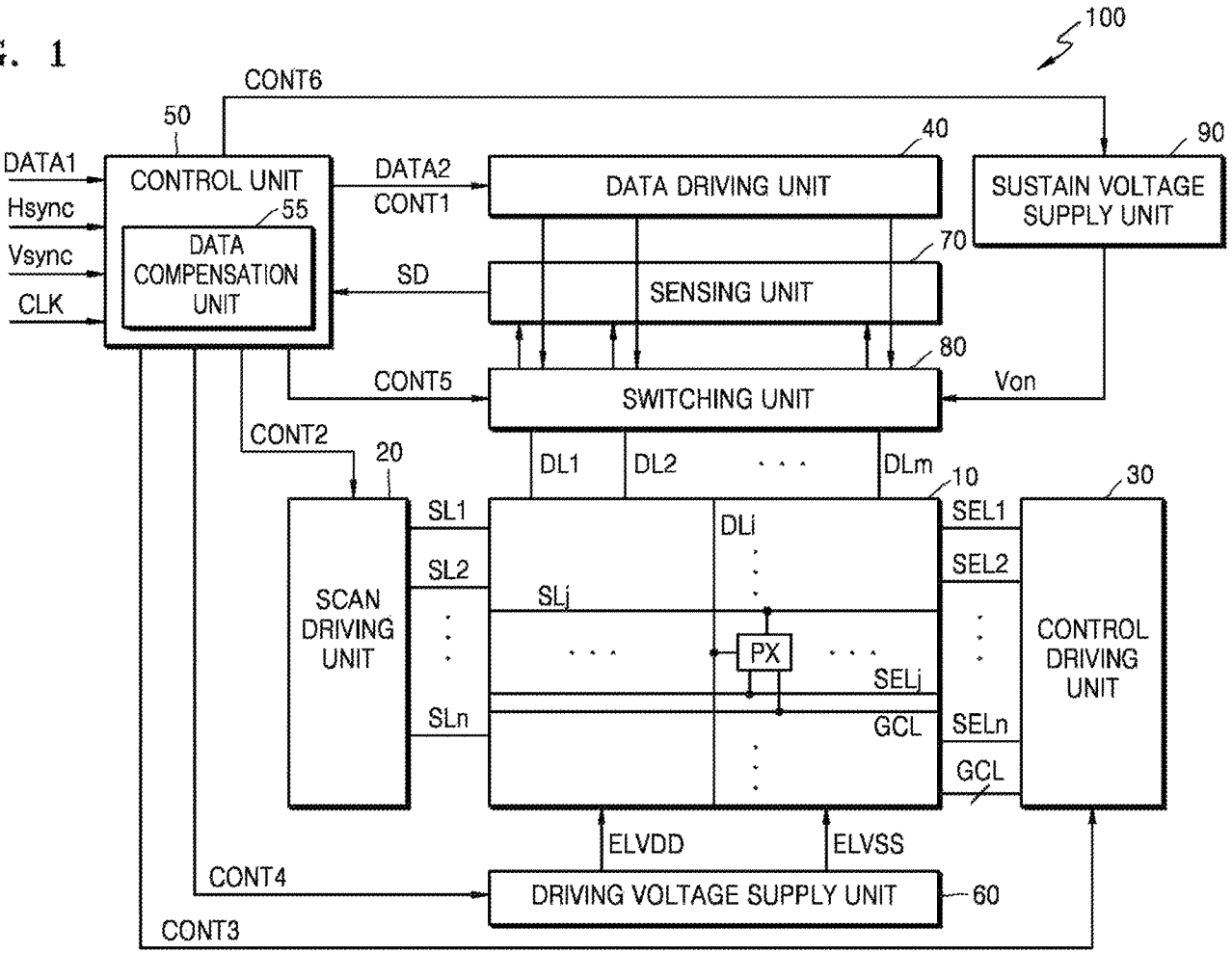
FIG. 1 is a block diagram of an organic light-emitting display apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items.

Hereinafter, the present exemplary embodiments will be described in detail with reference to the attached drawings. In the following description of the present exemplary embodiments, only essential parts for understanding operation of the present exemplary embodiments will be described and other parts may be omitted in order not to make the subject matter of the present exemplary embodiments unclear. All numerical values are approximate, and may vary. All examples of specific materials and compositions are to be taken as nonlimiting and exemplary only. Other suitable materials and compositions may be used instead.

It will be understood that although the terms "first," "second," etc. may be used herein to describe various components, these components should not be limited by these terms. These components are only used to distinguish one component from another. As used herein, the singular forms "a," "an," and "the" are intended to include the plural forms as well, unless the context clearly indicates otherwise. Throughout the specification, it will be understood that when an element is referred to as being "connected" to another element, it may be "directly connected" to the other element or "electrically connected" to the other element with intervening elements therebetween. It will be further understood that the terms "comprises" and/or "comprising" used herein specify the presence of stated features or components, but do not preclude the presence or addition of one or more other features or components.

FIG. 1 is a block diagram of an organic light-emitting display apparatus 100 according to an exemplary embodiment.

Referring to FIG. 1, the organic light-emitting display apparatus 100 includes a display unit 10, a scan driving unit 20, a control driving unit 30, a data driving unit 40, a control unit 50, a driving voltage supply unit 60, a sensing unit 70, a switching unit 80, and a sustain voltage supply unit 90.

The display unit 10 includes at least one pixel PX. The pixel PX is connected to a data line DLi transferring a sustain voltage and a data voltage, and includes an organic light-emitting diode, a driving transistor supplying a driving current to the organic light-emitting diode from a first driving voltage, a sensing transistor connected to the data line DLi and transferring the sustain voltage to an anode of the organic light-emitting diode in response to a sensing control signal, and a switching transistor connected to the data line DLi and transferring a data signal to the driving transistor in response to a scan signal.

The pixel PX illustrated in FIG. 1 is connected to a corresponding data line DLi from among data lines DL1 through DLm, to a corresponding scan line SLj from among scan lines SL1 through SLn, to a corresponding sensing control line SELj from among sensing control lines SEL1 through SELn, and a compensation control line GCL. Although FIG. 1 illustrates one pixel PX, the display unit 10 includes a plurality of pixels PXs. The plurality of pixels PXs is arranged in an approximate matrix shape.

Each of the plurality of pixels PXs may be connected to one of the scan lines SL1 through SLn which are connected to the scan driving unit 20, one of the sensing control lines SEL1 through SELn, one of the compensation control lines GCL which are connected to the control driving unit 30, and the data lines DL1 through DLm which are selectively connected to the data driving unit 40, the sensing unit 70, and the sustain voltage supply unit 90.

In other embodiments, in addition to the scan lines SL1 through SLn, the sensing control lines SEL1 through SELn and the compensation control lines GCL, and the data lines DL1 through DLm, each of the pixels PXs may be connected to sensing lines (for example, CLi of FIG. 6) which are connected to the sensing unit 70. In this case, the data lines DL1 through DLm may be selectively connected to the data driving unit 40 and the sustain voltage supply unit 90.

The pixels PXs are supplied with a first driving voltage ELVDD and a second driving voltage ELVSS from the driving voltage supply unit 60. The first driving voltage ELVDD may have two levels, that is, a high level and a low level, and the second driving voltage ELVSS may have two levels, that is, a high level and a low level.

Figure 4:
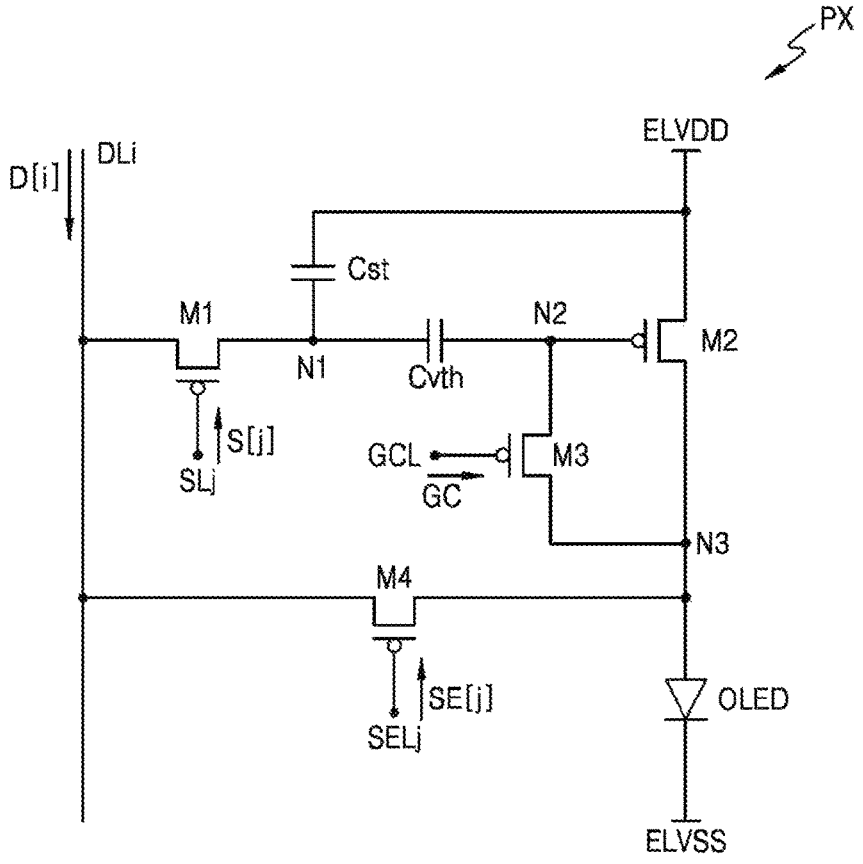
FIG. 4 is a circuit diagram of a pixel according to an exemplary embodiment.

The pixel PX may control an amount of current which is supplied to the second driving voltage ELVSS and which passes though the organic light-emitting diode from the first driving voltage ELVDD, based on a data signal D[i] transferred via the data line DLi (see FIG. 4). The data signal D[i] refers to a signal transferred via the data line DLi, and the data signal D[i] includes a first sustain voltage Vsus and a data voltage Vdata. The organic light-emitting diode emits light of a luminance corresponding to the data voltage Vdata.

The scan driving unit 20 generates scan signals S[1] through S[n] and transfers the scan signals S[1] through S[n] to each of the scan lines SL1 through SLn. The control driving unit 30 generates sensing control signals SE[1] through SE[n], and transfers the sensing control signals SE[1] through SE[n] to each of the sensing control lines SEL1 through SELn. The scan driving unit 20 also generates a compensation control signal GC and transfers the compensation control signal GC to the compensation control lines GCL. The compensation control lines GCL transfer the same compensation control signal GC to each of the pixels PXs in the display unit 10. A plurality of compensation control lines including the compensation control line GCL may be arranged in each row of the pixels PXs.

The data driving unit 40 transfers the first sustain voltage Vsus and the data voltage Vdata to each of the data lines DL1 through DLm. The data driving unit 40 generates the data voltage Vdata based on second image data DATA2 received from the control unit 50. The control unit 50 receives first image data DATA1 from an external source, and the data compensation unit 55 may convert the first image data DATA1 into the second image data DATA2 to compensate for a deterioration of the display unit 10.

The sensing unit 70 senses an anode voltage of the organic light-emitting diode when a reference current flows in the organic light-emitting diode of the pixel PX. In other embodiments, the sensing unit 70 senses a driving current output from the driving transistor of the pixel PX. The sensing unit 70 may be connected to the data lines DL1 through DLm via the switching unit 80, and may be connected to the pixels PXs via the data lines DL1 through DLm. The sensing unit 70 provides the sensed result to the control unit 50 as sensing data SD. The data compensation unit 55 may convert the first image data DATA1 into the second image data DATA2 based on the sensing data SD.

The switching unit 80 may selectively connect the data lines DL1 through DLm to any one of the data driving unit 40, the sensing unit 70, and the sustain voltage supply unit 90. For example, when the display unit 10 is to display an image, the switching unit 80 may connect the data lines DL1 through DLm to the data driving unit 40 so that the data signals D[1] through D[m] are provided to the pixels PXs. The switching unit 80 may connect the data lines DL1 through DLm to the sensing unit 70 so that characteristic information of the organic light-emitting diode is sensed by the sensing unit 70.

A point in time in which the sensing unit 70 senses the driving currents of the driving transistors of the pixels PXs is not particularly limited. The sensing may be performed whenever power is applied to the organic light-emitting display apparatus 100, or may be performed before the organic light-emitting display apparatus 100 is shipped as a product. In other embodiments, the sensing unit 70 may automatically operate periodically, or may randomly operate by a user's configuration.

The sustain voltage supply unit 90 may generate a second sustain voltage Von and supply the second sustain voltage Von to the data lines DL1 through DLm. Here, the switching unit 80 may connect the data lines DL1 through DLm to the sustain voltage supply unit 90.

The control unit 50 receives the first image data DATA1 and a synchronization signal input from an external device. The first image data DATA1 includes luminance information for the pixels PXs. The luminance has a predetermined number, for example, a gray value of 1024(=210), 256(=28), or 64(=26). The synchronization signal includes a horizontal synchronization signal Hsync, a vertical synchronization signal Vsync, and a clock signal CLK. The control unit 50 also receives the sensing data SD from the sensing unit 70.

The control unit 50 generates first through sixth control signals CONT1, CONT2, CONT3, CONT4, CONT5, and CONT6, and the second image data DATA2, according to the first image data DATA1, the sensing data SD, the horizontal synchronization signal Hsync, the vertical synchronization signal Vsync, and the clock signal CLK.

The control unit 50 divides the first image data DATA1 into frame units according to the vertical synchronization signal Vsync, divides the first image data DATA1 into scan line units according to the horizontal synchronization signal Hsync, and generates the second image data DATA2 based on the sensing data SD. The control unit 50 transfers the second image data DATA2, together with the first control signal CONT1, to the data driving unit 40.

The scan driving unit 20 is connected to the scan lines SL1 through SLn and generates the scan signals S[1] through S[n] according to the second control signal CONT2. The scan driving unit 20 may sequentially apply the scan signals S[1] through S[n], which comprise gate-on voltages, to the scan lines SL1 through SLn.

The control driving unit 30 is connected to the sensing control lines SEL1 through SELn and the compensation control lines GCL, and generates the sensing control signals SE[1] through SE[n] and the compensation control signal GC according to the third control signal CONT3.

The data driving unit 40 is connected to the data lines DL1 through DLm via the switching unit 80. The data driving unit 40 performs sampling and holding of the second image data DATA2 according to the first control signal CONT1, and transfers the data signals D[1] through D[m] to each of the data lines DL1 through DLm. The data driving unit 40 applies the data voltage Vdata, which has a predetermined voltage range, to the data lines DL1 through DLm in synchronization with the scan signals S[1] through S[n] of the gate-on voltage.

The driving voltage supply unit 60 determines levels of the first driving voltage ELVDD and the second driving voltage ELVSS, and supplies the first driving voltage ELVDD and the second driving voltage ELVSS to the pixels PXs according to the fourth control signal CONT4.

The switching unit 80 connects the data lines DL1 through DLm to any one of the data driving unit 40, the sensing unit 70, and the sustain voltage supply unit 90 according to the fifth control signal CONT5. When the switching unit 80 connects the data lines DL1 through DLm to the data driving unit 40, the data voltage Vdata and the first sustain voltage Vsus are applied to the data lines DL1 through DLm. When the switching unit 80 connects the data lines DL1 through DLm to the sustain voltage supply unit 90, the second sustain voltage Von is applied to the data lines DL1 through DLm. When the switching unit 80 connects the data lines DL1 through DLm to the sensing unit 70, a reference current Iref may flow and a voltage of the anode of the organic light-emitting diode may be transferred, via the data lines DL1 through DLm. The fifth control signal CONT5 may include a sustain voltage enable signal SUS_ENB which applies the second sustain voltage Von to the data lines DL1 through DLm.

The sustain voltage supply unit 90 is connected to the data lines DL1 through DLm via the switching unit 80, and applies the second sustain voltage Von to the data lines DL1 through DLm according to the sixth control signal CONT6.

Figure 2:
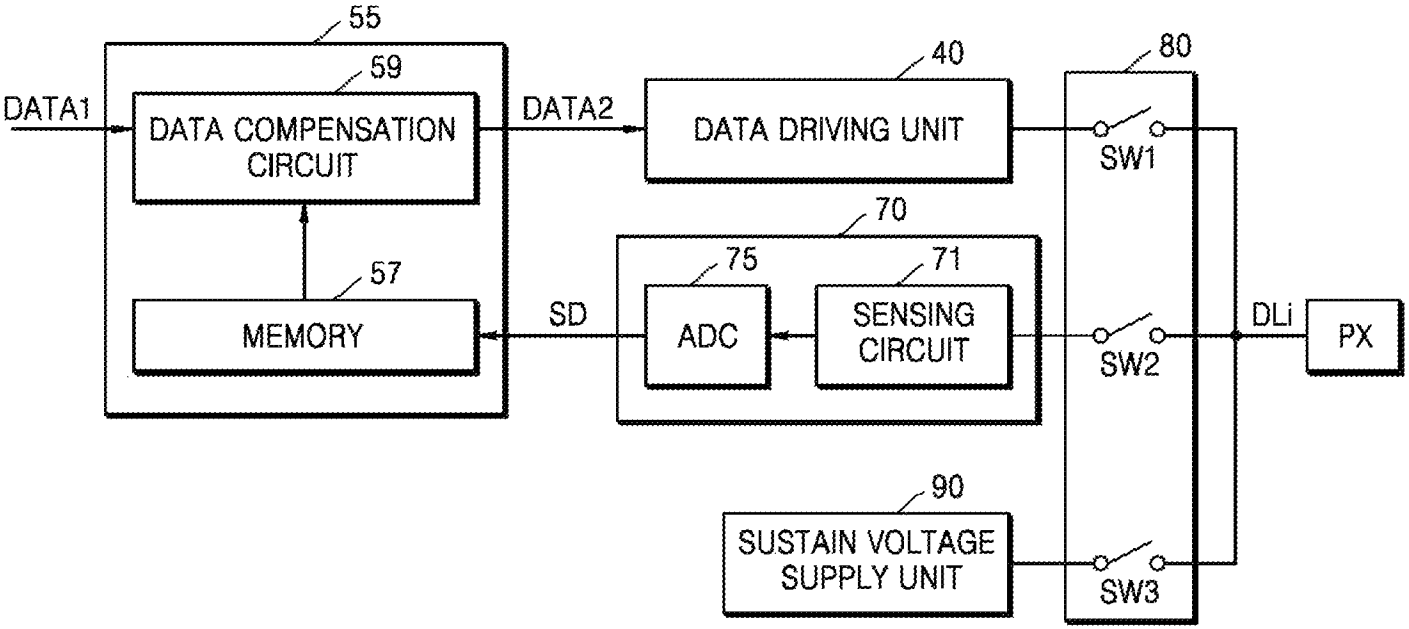
FIG. 2 is a block diagram illustrating further details of a portion of the organic light-emitting display apparatus of FIG. 1.

FIG. 2 is a block diagram illustrating further details of a portion of the organic light-emitting display apparatus 100 of FIG. 1.

FIG. 2 illustrates only some components of the organic light-emitting display apparatus 100 of FIG. 1. FIG. 2 exemplifies a pixel PX included in an $i^{th}$ pixel column, the switching unit 80 connected to the pixel PX via an $i^{th}$ data line DLi, the data driving unit 40, the sensing unit 70, the sustain voltage supply unit 90, and the data compensation unit 55.

Referring to FIG. 2, the switching unit 80 includes three switches SW1, SW2, and SW3 in each channel. The sensing unit 70 includes a sensing circuit 71 and an analog-to-digital converter (ADC) 75 in each channel. Here, each channel of the sensing unit 70 may have one ADC 75. In other embodiments, one ADC 75 may be shared by all channels of the sensing unit 70.

The first switch SW1 connects the data line DLi to the data driving unit 40. The first switch SW1 is turned on (i.e., closed) when the data signal D[i] and the first sustain voltage Vsus are output by the data driving unit 40, so as to be supplied to the data line DLi.

The third switch SW3 connects the data line DLi to the sustain voltage supply unit 90. The third switch SW3 is turned on (i.e., closed) when the second sustain voltage Von output by the sustain voltage supply unit 90 is supplied, so as to be output to the data line DLi.

The second switch SW2 connects the data line DLi to the sensing unit 70. The second switch SW2 is turned on (i.e., closed) when characteristic information of the organic light-emitting diode and/or the driving transistor in the pixel PX (for example, deterioration information of the organic light-emitting diode, mobility information of the driving transistor, and threshold voltage information of the driving transistor) is sensed via the sensing unit 70. The second switch SW2 may be turned on (i.e., closed) during a non-display time between a point in time when power is applied to the organic light-emitting display apparatus 100 and a point in time when an image is displayed, or may be turned on during a non-display time before the product is shipped.

Figure 3:
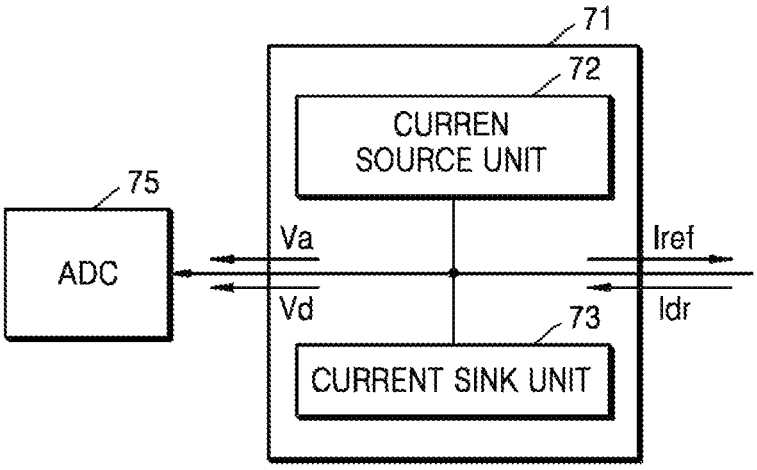
FIG. 3 is a block diagram illustrating further details of a sensing unit of FIG. 2.

FIG. 3 is a block diagram illustrating further details of the sensing unit 70 of FIG. 2.

Referring to FIG. 3, the sensing circuit 71 includes a current source unit 72 and a current sink unit 73. The current source unit 72 and the current sink unit 73 each may include a switching device for a selective connection.

The current source unit 72 supplies the reference current Iref to the pixel PX, and the ADC 75 senses a voltage Va generated in the anode of the organic light-emitting diode when the reference current Iref flows in the organic light-emitting diode of the pixel PX. The voltage Va includes deterioration information of the organic light-emitting diode in the pixel PX.

As the organic light-emitting diode deteriorates, a resistance value of the organic light-emitting diode changes. More specifically, since a voltage value of the voltage Va is changed according to a degree of deterioration of the organic light-emitting diode, the deterioration information of the organic light-emitting diode may be determined from the voltage Va.

A value of the reference current Iref may be set to vary. For example, the reference current Iref may be set as a current value Imax which flows in the organic light-emitting diode when the organic light-emitting diode of the pixel PX emits light of a maximum luminance.

The current sink unit 73 sinks a driving current Idr output from the driving transistor of the pixel PX, and the ADC 75 senses a voltage Vd generated in the drain of the driving transistor when the driving current Idr is sunk. The voltage Vd includes characteristic information of the driving transistor in the pixel PX, for example, mobility information or threshold voltage information.

Referring to FIG. 2 again, the ADC 75 generates the sensing data SD by converting the voltages Va and Vd supplied from the sensing circuit 71 into digital values.

The data compensation unit 55 includes a memory 57 and a data compensation circuit 59.

The memory 57 stores the sensing data SD supplied from an ADC 75. The memory 57 may store characteristic information for each of the pixels PX in the display unit 10.

The data compensation circuit 59 converts the first image data DATA1 received from an external device into the second image data DATA2, and provides the converted second image data DATA2 to the data driving unit 40. This conversion is accomplished by using the sensing data SD stored in the memory 57, so that a uniform image is displayed regardless of individual characteristics of the pixels PXs.

The data compensation circuit 59 generates the second image data DATA2 by increasing bit values of the first image data DATA1 as the organic light-emitting diode is deteriorated, based on the sensing data SD. The second image data DATA2 is transferred to the data driving unit 40 and the data voltage Vdata corresponding to the second image data DATA2 is ultimately provided to the pixel PX. Thus, even when the organic light-emitting diode deteriorates, light emitted by the organic light-emitting diode may have a uniform luminance.

The data driving unit 40 generates the data signal D[i] including the data voltage Vdata corresponding to the second image data DATA2, and provides the data signal D[i] to the pixel PX.

FIG. 4 is a circuit diagram of an example of a pixel PX according to an exemplary embodiment. The pixel PX illustrated in FIG. 4 may be included in the organic light-emitting display apparatus 100 of FIG. 1.

Referring to FIG. 4, the pixel PX includes a switching transistor M1, a driving transistor M2, a compensation transistor M3, a sensing transistor M4, a first capacitor Cvth, a second capacitor Cst, and an organic light-emitting diode OLED.

The switching transistor M1 includes a gate electrode connected to the scan line SLj, a first electrode connected to the data line DLi, and a second electrode connected to a first node N1. The switching transistor M1 is turned on by the scan signal S[j] when it is set to a gate-on voltage and transmitted to the gate of the switching transistor M1 via the scan line Slj. When turned on, the transistor M1 transfers the data signal D[i] from the data line DLi to the first node N1.

The driving transistor M2 includes a gate electrode connected to a second node N2, a first electrode to which the first driving voltage ELVDD is applied, and a second electrode connected to a third node N3. An anode of the organic light-emitting diode is connected to the third node N3, and the driving transistor M2 controls a driving current supplied to the organic light-emitting diode OLED from the first driving voltage ELVDD.

The compensation transistor M3 includes a gate electrode connected to the compensation control line GCL, a first electrode connected to the second node N2, and a second electrode connected to the third node N3. The compensation transistor M3 is turned on by the compensation control signal GC when it is set to a gate-on voltage and transferred via the compensation control line GCL, and connects the gate electrode and the second electrode of the driving transistor M2.

The sensing transistor M4 includes a gate electrode connected to the sensing control line SELj, a first electrode connected to the data line DLi, and a second electrode connected to the third node N3. The sensing transistor M4 is turned on by the sensing control signal SE[j] when it is set to a gate-on voltage and transferred via the sensing control line SELj, and connects the data line DLi and the third node N3.

The first capacitor Cvth includes a first electrode connected to the first node N1 and a second electrode connected to the second node N2.

The second capacitor Cst includes a first electrode connected to the first node N1, and a second electrode to which the first driving voltage ELVDD is applied.

The organic light-emitting diode OLED has an anode connected to the third node N3, and a cathode to which the second driving voltage ELVSS is applied. The organic light-emitting diode OLED may emit one of the primary colors of light. These primary colors may include red, green, and blue, and a desired color may be displayed by a spatial or temporal summation of the three primary colors. In other embodiments, the organic light-emitting diode may emit white light or light of any other color.

The switching transistor M1, the driving transistor M2, the compensation transistor M3, and the sensing transistor M4 may be p-channel electric field-effect transistors. Here, the gate-on voltage turning on the switching transistor M1, the driving transistor M2, the compensation transistor M3, and the sensing transistor M4 is a logic low level voltage and a gate-off voltage turning off the same is a logic high level voltage.

Although FIG. 4 illustrates that the transistors M1 through M4 are p-channel electric field-effect transistors, at least some of the transistors M1 through M4 may be n-channel electric field-effect transistors.

The first driving voltage ELVDD and the second driving voltage ELVSS are voltages for driving the pixel PX, and are supplied by the driving voltage supply unit 60. The first driving voltage ELVDD may be changed to a high level or a low level, and the second driving voltage ELVSS may also be changed to a high level or a low level.

Figure 5:
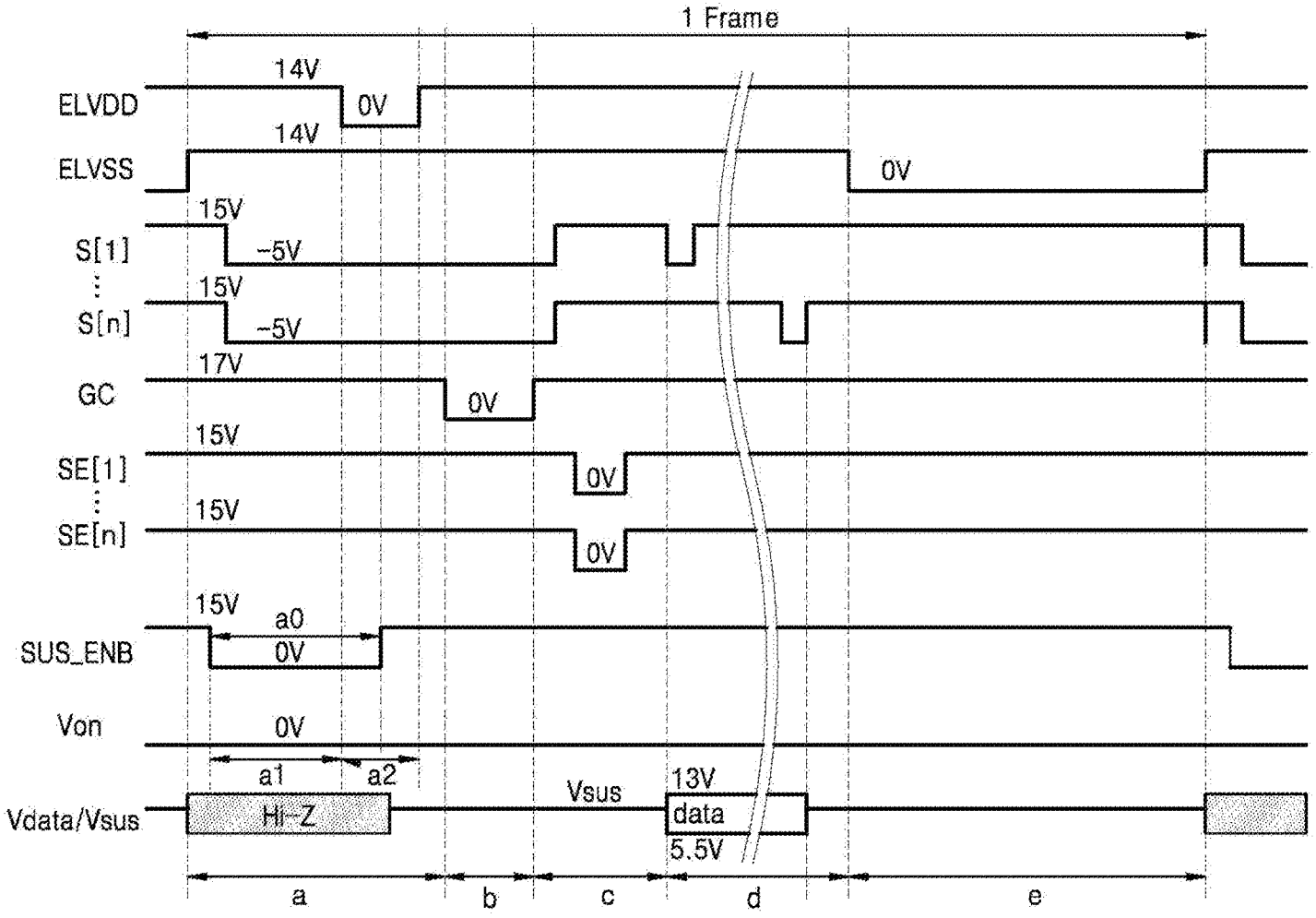
FIG. 5 is a timing diagram illustrating a method of driving an organic light-emitting display apparatus according to an exemplary embodiment.

FIG. 5 is a timing diagram illustrating a method of driving an organic light-emitting display apparatus according to an exemplary embodiment.

One frame period includes a reset section a, a threshold voltage compensation section b, an anode initialization section c, a data write section d, and an emission section e.

The reset section a includes a sustain voltage enable section a0 during which a zero magnitude of the second sustain voltage Von is applied to the data line DLi. The switching unit 80 connects the sustain voltage supply unit 90 to the data line DLi during the sustain voltage enable section a0. The third switch SW3 may be controlled by the sustain voltage enable signal SUS_ENB, and when the third switch SW3 is a p-channel electric field-effect transistor, the sustain voltage enable signal SUS_ENB may have a logic low level voltage in the sustain voltage enable section a0. The second sustain voltage Von is thus applied during the sustain voltage enable section a0.

The reset section a includes a first section a1 and a second section a2.

In the first section a1, the scan signals S[1] through S[n] are applied by a logic low level voltage (for example, −5V), and the sensing control signals SE[1] through SE[n] are applied by a logic high level voltage (for example, 15V). The first driving voltage ELVDD and the second driving voltage ELVSS are applied by a high level voltage (for example, 14V), the compensation control signal GC is applied by a logic high level voltage (for example, 17V), and the second sustain voltage Von of for example 0V is applied to the data line DLi. Since in the sustain voltage enable section a0, the data driving unit 40 is not connected to the data line DLi, the data driving unit 40 may output a random voltage or the first sustain voltage Vsus during the sustain voltage enable section a0.

The switching transistor M1 is turned on by the scan signals S[1] through S[n] set to the logic low level voltage (for example, −5V), and the second sustain voltage Von is transferred to the first node N1. A voltage of the first node N1 is changed to the second sustain voltage Von from the data voltage Vdata applied during a data write section of a previous frame, so that the magnitude of voltage change at the first node N1 becomes Von-Vdata. The data voltage Vdata refers to a voltage of the data signal D[j], and may have a range of 5.5V through 13V.

A voltage of the second node N2 is changed by the change in voltage of the first node N1, due to coupling by the first capacitor Cvth. The voltage of the second node N2 is ELVDD+Vth+(Vdata−Vsus) after the data write section d of the previous frame. This aspect will be described in more detail below with respect to the data write section d.

The voltage of the second node N2 becomes ELVDD+Vth+(Vdata−Vsus)+(Von−Vdata)=ELVDD+Vth−Vsus+Von, according to the voltage change of the first node N1. Here, ELVDD refers to the high level voltage of the first driving voltage ELVDD, Vth refers to the threshold voltage of the driving transistor M2, and Vsus refers to the first sustain voltage Vsus that the data driving unit 40 applies to the data line DLi during sections other than the data write section d. In some embodiments, the first sustain voltage Vsus may be substantially the same as the high level voltage of the first driving voltage ELVDD. The first sustain voltage Vsus may be, for example, 14V. In other embodiments, the first sustain voltage Vsus may be lower than the high level voltage of the first driving voltage ELVDD. The first sustain voltage Vsus may be, for example, 11V.

In the following description, the threshold voltage Vth of the driving transistor M2 is assumed to be, for example, −3V, and the first sustain voltage Vsus is assumed to be, for example, 14V.

In the first section a1, when the second sustain voltage Von is 0V, the voltage of the second node N2 becomes 14−3−14+0=−3V. The gate voltage of the driving transistor M2 may thus be reset to −3V in the first section a1 so that a hysteresis of the driving transistor M2 may be removed. The first section a1 may therefore be referred to as a hysteresis removing section.

In the second section a2, the second driving voltage ELVSS may maintain the high level voltage (for example, 14V), and the first driving voltage ELVDD may be changed to a logic low level voltage (for example, 0V). Here, the scan signals S[1] through S[n] maintain their logic low level voltage (for example, −5V), and the compensation control signal GC is kept at a logic high level voltage (for example, 17V).

Accordingly, the anode voltage of the organic light-emitting diode OLED becomes higher than the low level of the first driving voltage ELVDD, and from the perspective of the driving transistor M2, the anode of the organic light-emitting diode OLED becomes a source of the driving transistor M2. A gate voltage of the driving transistor M2 is ELVDD+Vth-Vsus+Von. The driving transistor M2 is turned on according to a gate-source voltage thereof, and a current flows from the anode of the organic light-emitting diode OLED to a node to which the first driving voltage ELVDD is applied, via the driving transistor M2. Here, the current flowing via the driving transistor M2 flows until the anode voltage of the organic light-emitting diode OLED becomes ELVDD−Vsus+Von. The anode voltage of the organic light-emitting diode OLED becomes ELVDD−Vsus+Von=0V. The second section a2 may thus be referred to as an anode reset section.

In the compensation section b, the scan signals S[1] through S[n] are set to a logic low level voltage (for example, −5V), the compensation control signal GC is set to a logic low level voltage (for example, 0V), the sensing control signals SE[1] through SE[n] are set to a logic high level voltage (for example, 15V), and the first driving voltage ELVDD and the second driving voltage ELVSS are set to a high level voltage (for example, 14V). Here, the sustain voltage enable signal SUS_ENB is set at a logic high level voltage (for example, 15V) so that the data line DL1 is connected to the data driving unit 40. Thus the data driving unit 40 outputs or applies the first sustain voltage Vsus to the data line DLi during the compensation section b.

The switching transistor M1 and the compensation transistor M3 are thereby turned on. When the switching transistor M1 is turned on, the first sustain voltage Vsus is transferred to the first node N1. When the compensation transistor M3 is turned on, the driving transistor M2 is diode-connected to electrically connect the gate of the driving transistor M2 with the drain of the driving transistor M2. When the driving transistor M2 is diode-connected, the gate voltage of the driving transistor M2, that is, the voltage of the second node N2, becomes ELVDD+Vth=14−3=11V. The ELVDD+Vth−Vsus voltage (for example, 14−3−14=−3V) is stored in the first capacitor Cvth. A voltage of the third node N3 becomes ELVDD+Vth, that is, 11V, which is the same as the voltage of the second node N2, due to the turned-on compensation transistor M3.

As shown above, the ELVDD+Vth-Vsus voltage, in which the threshold voltage Vth of the driving transistor M2 is reflected, is stored in the first capacitor Cvth during the compensation section b. After the compensation section b, the compensation control signal GC and the scan signals S[1] through S[n] are changed to logic high level voltages. Even if the compensation transistor M3 is turned off and the switching transistor M1 is turned off, the ELVDD+Vth-Vsus voltage stored in the first capacitor Cvth is maintained.

In the anode initialization section c, the sensing control signals SE[1] through SE[n] are set to a logic low level voltage (for example, 0V) for a certain duration, so that all sensing transistors M4 are turned on. Both of the scan signals S[1] through S[n] and the compensation control signal GC are set to a logic high level voltage for at least a certain duration, so that both of the switching transistors M1 and the compensation transistor M3 are turned off. The first driving voltage ELVDD and the second driving voltage ELVSS are logic high level voltages (for example, 14V). The sustain voltage enable signal SUS_ENB is also set to a logic high level voltage (for example, 15V) so that the data line DLi is connected to the data driving unit 40. The data driving unit 40 outputs the first sustain voltage Vsus to the data line DLi during the anode initialization section c.

When the sensing transistor M4 is turned on, the first sustain voltage Vsus of the data line DLi is applied to the third node N3. The voltage of the third node N3 becomes the first sustain voltage Vsus, that is, 14V. However, the ELVDD+Vth-Vsus voltage stored in the first capacitor Cvth is maintained.

When there is no anode initialization section c, the voltage of the third node N3 does not maintain the ELVDD+Vth voltage, that is, 11V, but gradually rises. When the voltage of the third node N3 rises, the gate voltage of the driving transistor M2, i.e. the voltage of the second node N2, also gradually rises due to a capacitive coupling between the gate and the drain of the driving transistor M2. However, the data signal is written in pixels PXs in different points in time, according to locations of the pixels PXs. Thus, pixels in which the data signal is first written have a lower data signal than pixels in which the data signal is later written. Due to this time difference, an image of non-uniform quality may be displayed.

In some embodiments, the same voltage, that is, the first sustain voltage Vsus, is applied to the third node N3 of all pixels PXs, during the anode initialization section c. The first sustain voltage may be substantially the same as the high level of the first driving voltage ELVDD. In this case, the voltage of the third node N3 does not rise any more. Accordingly, the voltage of the second node N2 does not rise either, after the anode initialization section c. Thus, even if data are written to the pixels PXs at different times, the voltage of the second node N2 does not change, and thus, the data voltage may be uniformly written in the pixels PXs. Thus, the image is more uniform in appearance.

In the data write section d, the scan signals S[1] through S[n] are sequentially set to a logic low level voltage (−5V), to turn on their respective switching transistors M1. The sensing control signals SE[1] through SE[n] are set to a logic high level voltage (for example, 15V), to turn off all sensing transistors M4. Here, the first driving voltage ELVDD and the second driving voltage ELVSS are a logic high level voltage of 14V. The sustain voltage enable signal SUS_ENB is set to a logic high level voltage (15V), and the data signal D[j] output from the data driving unit 40 is applied to the data line DLi. The data signal D[j] may be the data voltage Vdata and may, for example, have a range of 5.5V through 13V.

When the switching transistor M1 is turned on, the data voltage Vdata is transferred to the first node N1. The voltage of the first node N1 is changed from the first sustain voltage Vsus to the data voltage Vdata, and the amount by which voltage is changed at the first node N1 becomes Vdata-Vsus. The data voltage Vdata of the first node N1 is stored in the second capacitor Cst.

Due to a coupling by the first capacitor Cvth, the voltage of the second node N2 is changed by the amount (Vdata−Vsus) of the first node N1, to become ELVDD+Vth+(Vdata−Vsus). That is, the data voltage Vdata is reflected in the gate voltage of the driving transistor M2.

When the emission section e starts, the first driving voltage ELVDD maintains a logic high level voltage (14V), and the second driving voltage ELVSS is converted to a logic low level voltage (0V). More generally, a voltage difference between the first driving voltage ELVDD and the second driving voltage ELVSS is generated by changing the voltage level of any one of the first driving voltage ELVDD and the second driving voltage ELVSS. Here, the scan signals S[1] through S[n] are set to a logic high level voltage (15V), the sensing control signals SE[1] through SE[n] are set to a logic high level voltage (for example, 15V), the compensation control signal GC is set to a logic high level voltage (17V), and the first sustain voltage Vsus is applied to the data line DLi.

When the second driving voltage ELVSS is converted to the logic low level voltage (0V), a current flows in the organic light-emitting diode OLED via the driving transistor M2. The current flowing via the driving transistor M2 becomes Ioled=β/2(Vgs−Vth)2=β/2 [{ELVDD+Vth+(Vdata−Vsus)−ELVDD}−Vth]2=β/2(Vdata−Vsus)2. That is, the driving transistor M2 supplies the current corresponding to the data voltage Vdata reflected in the gate voltage, to the organic light-emitting diode OLED. The organic light-emitting diode OLED emits light by a luminance corresponding to the current flowing in the driving transistor M2.

As a result, the current flowing in the organic light-emitting diode OLED is not affected by a threshold voltage deviation of the driving transistor M2 and a voltage drop of the first driving voltage ELVDD.

Figure 6:
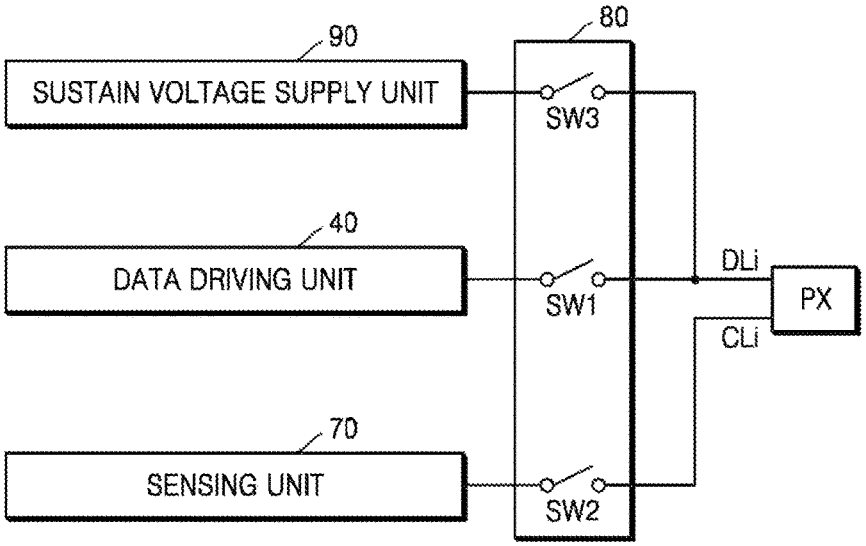
FIG. 6 is a block diagram of components of an organic light-emitting display apparatus according to another exemplary embodiment.

FIG. 6 is a block diagram of some components of an organic light-emitting display apparatus according to another exemplary embodiment.

Referring to FIG. 6, with the exception of the pixel PX being connected to the second switch SW2 via the sensing line CLi, the components of the organic light-emitting display apparatus of FIG. 6 are substantially the same as the components of the organic light-emitting display apparatus of FIG. 2. That is, the pixel PX may be connected to the sustain voltage supply unit 90 and the data driving unit 40 via the data line DLi, and may be connected to the sensing unit 70 via an additional sensing line CLi.

Figure 7:
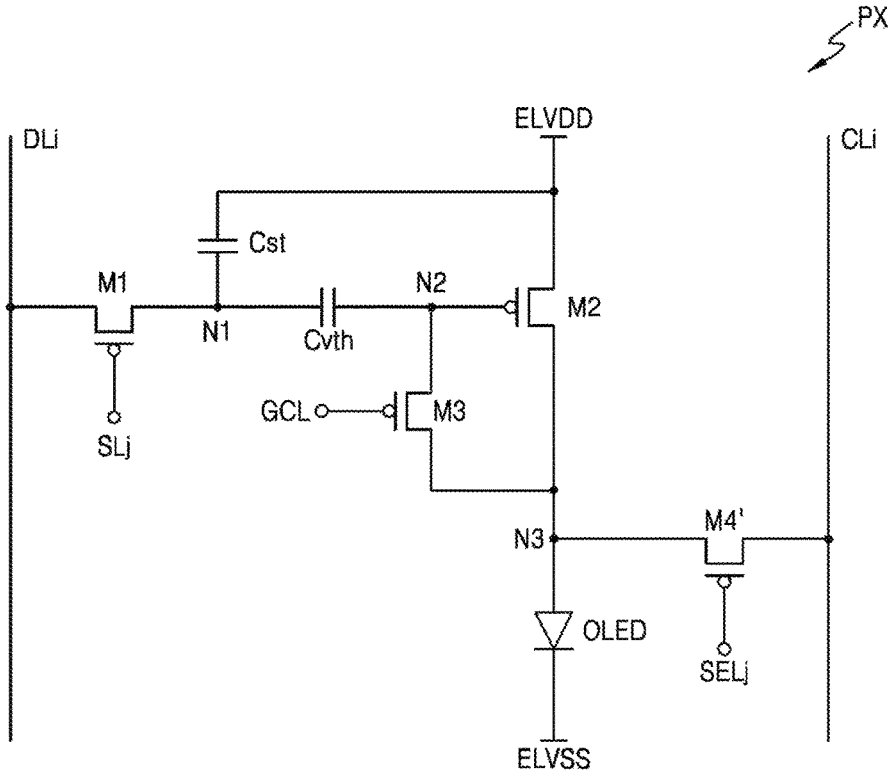
FIG. 7 is a circuit diagram of a pixel according to another exemplary embodiment.

FIG. 7 is a circuit diagram of an example of a pixel according to another exemplary embodiment. The pixel PX illustrated in FIG. 7 may be included in the organic light-emitting display apparatus of FIG. 6.

Referring to FIG. 7, the pixel PX is connected not only to the data line DLi but also to the sensing line CLi. A sensing transistor M4' connects an anode of an organic light-emitting diode to the sensing line CLi.

The sensing unit 70 may generate an initialization voltage and apply the initialization voltage to the sensing line CLi. The sensing transistor M4' may apply the initialization voltage transferred via the sensing line CLi to the third node N3, that is, the anode of the organic light-emitting diode OLED.

The sensing transistor M4' may transfer characteristic information of the driving transistor M2 or characteristic information of the organic light-emitting diode OLED to the sensing line CLi.

As described above, according to the one or more of the above exemplary embodiments, characteristics of the driving transistor and/or the organic light-emitting diode of the organic light-emitting display apparatus may be accurately sensed. Also, the anode voltage of the organic light-emitting diode of the pixels PXs may be more uniformly initialized between the threshold voltage compensation section and the data write section, in order to prevent image quality deterioration due to different data writes occurring at different times. In addition, the anode voltage of the organic light-emitting diode is initialized by using an existing transistor for sensing a deterioration degree of the driving transistor and/or the organic light-emitting diode, so that an additional transistor is not included in the pixel. Accordingly, the organic light-emitting display apparatus may have an improved image quality.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims. Furthermore, different features of the various embodiments, disclosed or otherwise understood, can be mixed and matched in any manner to produce further embodiments within the scope of the invention.

What is claimed is:

1. A method of driving an organic light-emitting display apparatus comprising:

an organic light-emitting diode;

a driving transistor arranged to receive a first driving voltage and to supply a driving current to the organic light-emitting diode;

a data line arranged to transfer a sustain voltage and a data voltage;

a sensing transistor which is connected to the data line, and which is arranged to transfer the sustain voltage to an anode of the organic light-emitting diode in response to a sensing control signal;

a switching transistor which is connected to the data line, and which is arranged to transfer the data voltage to the driving transistor in response to a scan signal;

a data compensation circuit in electrical communication with the sensing transistor, the data compensation circuit configured to compensate image data according to characteristic information of the organic light-emitting diode, the characteristic information transmitted to the data compensation circuit through the sensing transistor and the data line; and a compensation transistor arranged to diode-connect the driving transistor in response to a compensation control signal, the method comprising, during one frame, sequentially turning on the compensation transistor, the sensing transistor and the switching transistor, wherein, during the one frame, when the sensing transistor is turned on, the anode of the organic light-emitting diode receives the sustain voltage via the data line, and wherein, during the one frame, when the switching transistor is turned on, the data voltage is transferred from the data line to the driving transistor.

2. The method of claim 1, wherein the sequentially turning on the compensation transistor, the sensing transistor and the switching transistor comprises:

performing a threshold voltage compensation operation in which the compensation transistor is turned on, after the threshold voltage compensation operation, performing an anode initialization operation in which the sensing transistor is turned on, and after the anode initialization operation, performing a data write operation in which the switching transistor is turned on.

3. The method of claim 2, further comprising:

before the threshold voltage compensation operation, performing a reset operation in which the driving transistor is turned on while a high level of a second driving voltage is applied to a cathode of the organic light-emitting diode, and after the data write operation, performing an emission operation in which the organic light-emitting diode emits light according to the data voltage upon receiving a low level of the second driving voltage.

4. The method of claim 1, wherein the organic light-emitting display apparatus further comprises:

a first capacitor which has a first electrode connected to the switching transistor and a second electrode connected to a gate electrode of the driving transistor, so as to store a threshold voltage of the driving transistor; and a second capacitor which has a first electrode connected to the first electrode of the first capacitor and a second electrode arranged to receive the first driving voltage, so as to store the data voltage.

5. The method of claim 1, wherein the organic light-emitting display apparatus further comprises a sensing circuit arranged to supply a reference current to the organic light-emitting diode, to sense a voltage of the anode of the organic light-emitting diode when the reference current flows in the organic light-emitting diode, and to provide the sensed voltage to the data compensation circuit as the characteristic information, wherein the sensing transistor is further arranged to receive the reference current output from the sensing circuit via the data line, to transfer the reference current to the organic light-emitting diode, and to transfer the voltage of the anode of the organic light-emitting diode to the sensing circuit via the data line.

6. The method of claim 5, wherein:

the sensing circuit is further arranged to sense the driving current output from the driving transistor, and to provide the sensed current to the data compensation circuit as the characteristic information of the driving transistor, the data compensation circuit is further arranged to compensate the image data according to the characteristic information of the driving transistor, and the sensing transistor is further arranged to transfer the driving current output from the driving transistor to the sensing circuit via the data line.

7. The method of claim 1, wherein the organic light-emitting display apparatus further comprises a driving voltage supply unit arranged to supply two levels of the first driving voltage, the two levels of the first driving voltage including a high level and a low level, and to supply two levels of a second driving voltage to a cathode of the organic light-emitting diode, the two levels of the second driving voltage including a high level and a low level.

8. The method of claim 7, wherein the sustain voltage has substantially the same magnitude as the high level of the first driving voltage.

9. A method of driving an organic light-emitting display apparatus comprising:

an organic light-emitting diode;

a driving transistor arranged to receive a first driving voltage and to supply a driving current to the organic light-emitting diode;

a sensing transistor which is connected to a sensing line so as to transfer an initialization voltage from the sensing line to an anode of the organic light-emitting diode in response to a sensing control signal;

a switching transistor which is connected to a data line so as to transfer a data voltage from the data line to the driving transistor in response to a scan signal; and a data compensation circuit in electrical communication with the sensing transistor, the data compensation circuit configured arranged to compensate image data according to characteristic information of the organic light-emitting diode, the characteristic information transmitted to the data compensation circuit through the sensing transistor and the sensing line; and a compensation transistor arranged to diode-connect the driving transistor in response to a compensation control signal, the method comprising, during one frame, sequentially turning on the compensation transistor, the sensing transistor and the switching transistor, wherein, during the one frame, when the sensing transistor is turned on, the anode of the organic light-emitting diode receives the initialization voltage via the sensing line, and wherein, during the one frame, when the switching transistor is turned on, the data voltage is transferred from the data line to the driving transistor.

10. The method of claim 9, wherein the organic light-emitting display apparatus further comprises:

a first capacitor which has a first electrode connected to the switching transistor and a second electrode connected to a gate electrode of the driving transistor, so as to store a threshold voltage of the driving transistor; and a second capacitor which has a first electrode connected to the first electrode of the first capacitor and a second electrode arranged to receive the first driving voltage, so as to store the data voltage.

11. The method of claim 9, wherein the organic light-emitting display apparatus further comprises a sensing circuit arranged to supply a reference current to the organic light-emitting diode, to sense a voltage of the anode of the organic light-emitting diode when the reference current flows in the organic light-emitting diode, and to provide the sensed voltage to the data compensation circuit as the characteristic information, wherein the sensing transistor is further arranged to receive the reference current output from the sensing circuit via the sensing line, to transfer the reference current to the organic light-emitting diode, and to transfer the voltage of the anode of the organic light-emitting diode to the sensing circuit via the sensing line.

12. A method of driving an organic light-emitting display apparatus comprising a pixel comprising:

an organic light-emitting diode;

a driving transistor which has a source arranged to receive a first driving voltage and a drain which is connected to the organic light-emitting diode;

a switching transistor which is connected to a data line so as to be arranged to transfer a data voltage to a first node in response to a scan signal;

a first capacitor which is connected between the first node and a gate of the driving transistor;

a second capacitor which is connected between the first node and the source of the driving transistor;

a compensation transistor which connects the gate and the drain of the driving transistor in response to a compensation control signal; and a sensing transistor which is connected to the data line so as to be arranged to transfer a first sustain voltage to an anode of the organic light-emitting diode in response to a sensing control signal, the method comprising, during one frame:

performing a threshold voltage compensation operation in which a threshold voltage of the driving transistor is stored in the first capacitor by turning on the compensation transistor;

after the threshold voltage compensation operation, performing an anode initialization operation in which the switching transistor is turned off, the compensation transistor is turned off, the sensing transistor is turned on, and the first sustain voltage is applied to the anode of the organic light-emitting diode; and after the anode initialization operation, performing a data write operation in which the data voltage is stored in the second capacitor by turning off the compensation transistor, turning off the sensing transistor, and turning on the switching transistor.

13. The method of claim 12, further comprising performing a reset operation in which the organic light-emitting diode becomes non-emissive by transitioning a second driving voltage applied to a cathode of the organic light-emitting diode from a low level to a high level, and removing a hysteresis of the driving transistor by supplying a second sustain voltage to the data line.

14. The method of claim 13, further comprising, after the reset operation, performing an anode reset operation in which an anode voltage of the organic light-emitting diode is reset by transitioning the first driving voltage to a low level in a state in which the driving transistor is turned on.

15. The method of claim 14, wherein the threshold voltage compensation operation is performed between the anode reset operation and the anode initialization operation.

16. The method of claim 15, further comprising, after the data write operation, performing an emission operation in which the organic light-emitting diode emits light according to the data voltage, the emission operation comprising transitioning the second driving voltage from the high level to the low level.

* * * * *